US010486040B2

(12) United States Patent
Novak et al.

(10) Patent No.: US 10,486,040 B2
(45) Date of Patent: Nov. 26, 2019

(54) GOLF CLUB CLEANING APPARATUS

(71) Applicants: Sil Trade, LLC, Fort Lauderdale, FL (US); GATO d.o.o., Maribor (SI)

(72) Inventors: Gabriel Novak, Maribor (SI); Anton Zilavec, Zgornja Polskava (SI)

( * ) Notice: Subject to any disclaimer, the term of this patent is extended or adjusted under 35 U.S.C. 154(b) by 157 days.

(21) Appl. No.: 15/844,129

(22) Filed: Dec. 15, 2017

(65) Prior Publication Data

US 2019/0184248 A1 Jun. 20, 2019

(51) Int. Cl.
*A63B 57/60* (2015.01)
*A46B 13/00* (2006.01)

(52) U.S. Cl.
CPC ..... *A63B 57/60* (2015.10); *A46B 13/001* (2013.01)

(58) Field of Classification Search
CPC ..... A63B 57/60; A46B 13/001; A46B 13/02; A01K 13/001
See application file for complete search history.

(56) References Cited

U.S. PATENT DOCUMENTS 6,269,509 B1 * 8/2001 Mays ..... A46B 13/02 134/191
2004/0255990 A1 * 12/2004 Taylor ..... B24C 7/0046 134/94.1
2012/0260864 A1 * 10/2012 Jonsson ..... A01K 13/001 119/609

* cited by examiner

*Primary Examiner* — Shay Karls
(74) *Attorney, Agent, or Firm* — Cionca IP Law P.C.; Marin Cionca

(57) ABSTRACT

A golf club cleaning apparatus having: a housing; a water supply pipe; a waste water pipe; a top opening permitting access to: a first axle associated with a first brush, and a second axle associated with a second brush; the axles being associated with compressible elements biasing the first axle and the second axle and thus the brushes towards each other; the first brush and the second brush being configured to engage in a rotational movement via a motor; and a plurality of sprinklers associated with the water supply pipe configured to discharge water to the brushes; a water trap connected to the waste water pipe to drain waste water out of the apparatus; means for driving the rotational movement; and a card reader configured to process a payment, and associated with a logic configured to restrict an initiation of a cleaning procedure until the payment is processed.

20 Claims, 14 Drawing Sheets

GOLF CLUB CLEANING APPARATUS

BACKGROUND OF INVENTION

1. Field of the Invention

The invention relates generally to sporting equipment maintenance and more specifically to cleaning golf clubs.

2. Description of the Related Art

Employees of golf courses or golf players must maintain the quality of their sporting equipment, and this may require them to manually clean their golf clubs. This can be a time-consuming and laborious process, particularly if a user frequents the golf course, or uses multiple golf clubs during an outing. The cleaning and maintenance of all golf clubs used in a set of clubs may be a difficult process for some golf players. Thus, there is a need for a more efficient or automated process for the cleaning of golf clubs for golf players.

The aspects or the problems and the associated solutions presented in this section could be or could have been pursued; they are not necessarily approaches that have been previously conceived or pursued. Therefore, unless otherwise indicated, it should not be assumed that any of the approaches presented in this section qualify as prior art merely by virtue of their presence in this section of the application.

BRIEF INVENTION SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

In an aspect a golf club cleaning apparatus is for performing a cleaning procedure on a golf club is provided, the apparatus comprising: a housing having eight side walls, a top side, a bottom side, an exterior surface and a hollow interior; a plurality of ventilation openings on the housing; a plurality of golf club holders on the exterior surface of the housing; a support frame within the housing and secured to the hollow interior; wherein one of the eight side walls is a rear side wall, the rear side wall having: an electromagnetic water supply valve opening providing access for a water supply pipe into the apparatus, wherein the water supply pipe has an electromagnetic water supply valve configured to open or close the water supply pipe, such that water enters the water supply pipe when the electromagnetic water supply valve is opened and such that the water flows towards a regulation valve; a regulation valve opening providing a user access to the regulation valve, the regulation valve being configured to control a flow of the water from the water supply pipe and direct the water into a water delivery pipe having a first pipe branch and a second pipe branch; a power cable opening permitting passage of a power cable connected to a frequency inverter to provide a power supply to the apparatus; a waste water pipe opening permitting passage of a waste water pipe out of the apparatus; a cover on the top side of the housing, the cover having a downward slope and a top opening having a rubber edging and broom bristles configured to reduce a spray of water out of the apparatus, the opening permitting access to an upper water trap and components housed by the upper water trap; the components housed by the upper water trap comprising: a first axle and a second axle, the first and second axles being received into the upper water trap through a first set of holes on a first upper water trap side wall, and the first axle and the second axle passing out of the upper water trap through a second set of holes on an opposite second side wall; the first axle being associated with a first brush, and the second axle being associated with a second brush, the first brush and the second brush being accessible through the top opening, the first axle and the second axle being associated with the support frame via a set of compressible elements biasing the first axle and the second axle towards each other and thus biasing the first brush and the second brush towards each other, and permitting a separation of the brushes when a force of is applied between the first brush and the second brush; the first brush and the second brush being configured to engage in a rotational movement towards each other via the drive belt driven by the electric motor; and the first pipe branch having a first set of sprinklers to discharge the water to the first brush, and the second pipe branch having a second set of sprinklers to discharge water to the second brush; a lower water trap underneath the upper water trap configured to catch waste water generated by the cleaning procedure, the lower water trap having a funnel shape and connected to the waste water pipe such that the waste water is drained out of the apparatus; an electrical motor associated with the frequency inverter, the electric motor configured to drive the rotational movement of the axles via a drive belt; a pulley pair and a main pulley associated with the drive belt configured to drive the rotational movement of the axles and thus a rotational movement of the brushes; and wherein one of the eight side walls is a front side wall having: an emergency shut-off switch configured to turn off the electric motor when actuated by the user; and a card reader configured to accept and process a payment, and associated with a logic configured to restrict an initiation of the cleaning procedure until the payment is processed; such that the user is permitted use of the cleaning procedure for the golf club after providing the payment. Thus, an advantage is that water can be saved over a user cleaning their golf clubs by hand. Another advantage is that the user need not expend the time or energy to manually clean their golf clubs, or need to move their golf clubs while it is being cleaned by the machine. Another advantage is that a plurality of golf clubs may be arranged in a spatially efficient manner.

The above aspects or examples and advantages, as well as other aspects or examples and advantages, will become apparent from the ensuing description and accompanying drawings.

BRIEF DESCRIPTION OF THE DRAWINGS

For exemplification purposes, and not for limitation purposes, aspects, embodiments or examples of the invention are illustrated in the figures of the accompanying drawings, in which.

DETAILED DESCRIPTION

Figure 1A:
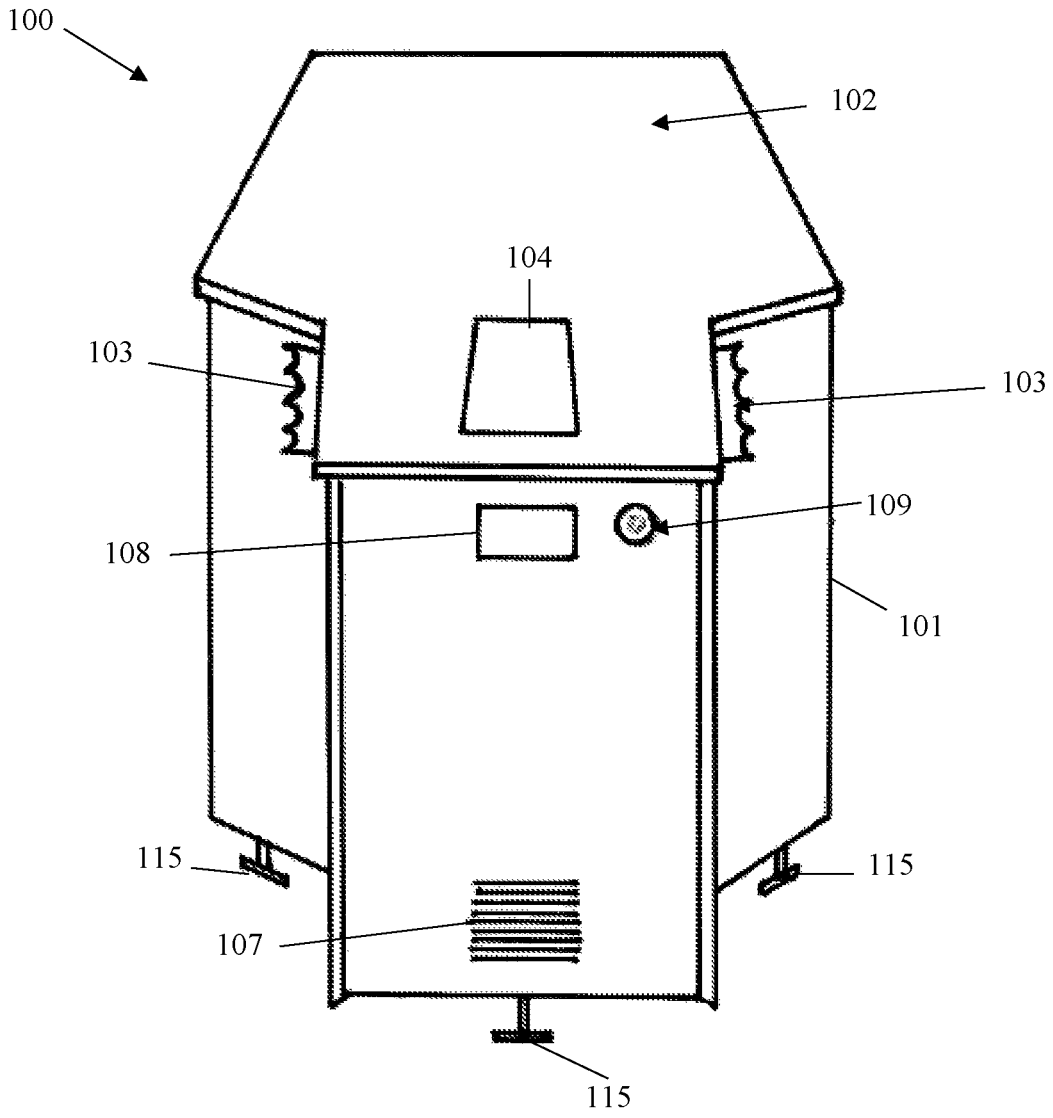
FIGS. 1A-1B illustrate the top, front perspective view of the golf club cleaner and another example of the golf club cleaner, respectively, according to an aspect.

What follows is a description of various aspects, embodiments and/or examples in which the invention may be practiced. Reference will be made to the attached drawings, and the information included in the drawings is part of this detailed description. The aspects, embodiments and/or examples described herein are presented for exemplification purposes, and not for limitation purposes. It should be understood that structural and/or logical modifications could be made by someone of ordinary skills in the art without departing from the scope of the invention. Therefore, the scope of the invention is defined by the accompanying claims and their equivalents.

It should be understood that, for clarity of the drawings and of the specification, some or all details about some structural components or steps that are known in the art are not shown or described if they are not necessary for the invention to be understood by one of ordinary skills in the art.

For the following description, it can be assumed that most correspondingly labeled elements across the figures (e.g., 703 and 803, etc.) possess the same characteristics and are subject to the same structure and function. If there is a difference between correspondingly labeled elements that is not pointed out, and this difference results in a non-corresponding structure or function of an element for a particular embodiment, example or aspect, then the conflicting description given for that particular embodiment, example or aspect shall govern.

Figure 1B:
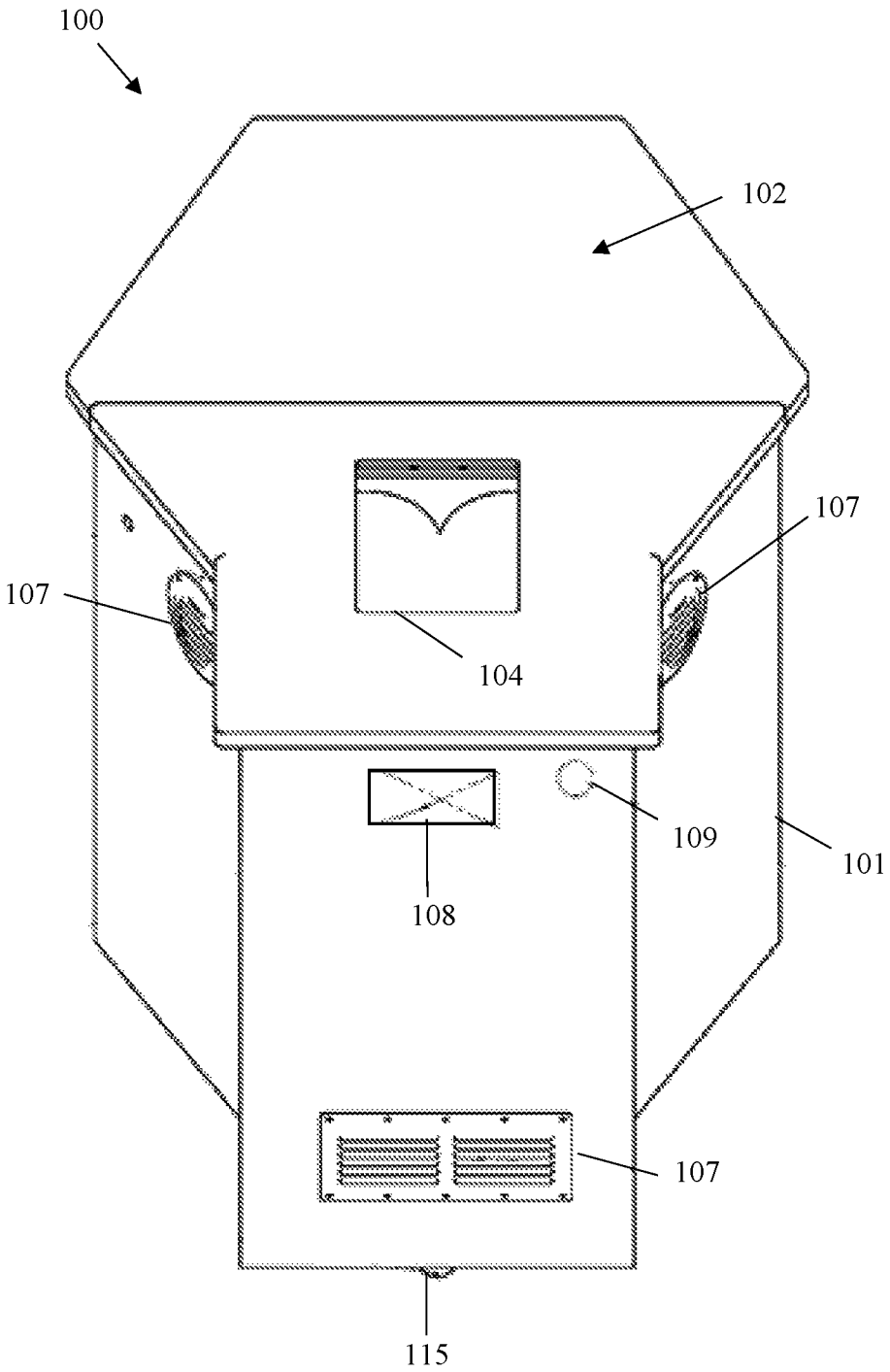

FIGS. 1A-1B illustrate the top, front perspective view of the golf club cleaning apparatus ("golf club cleaning apparatus," "golf club cleaner," "cleaning apparatus," or "cleaner") 100 and another example of the golf club cleaner 100, respectively, according to an aspect. The cleaner may be constructed that individuals of various heights may easily use the apparatus. As an example, the cleaner 100 may be constructed with the following dimensions: 68 centimeters (cm) in width, 74 cm in length, and 75-82 cm in height, such that the cleaner 100 may ergonomically be comfortable for users placing their items into the cleaner or removing their items from the cleaner.

The cleaner may be provided with built-in golf club holders 103 (as shown in FIG. 1A, not shown in FIG. 1B), which may be constructed from, for example, inox steel or any other suitable material, and may be used for storing or holding golf clubs before or after they are cleaned. As shown as an example, the built-in golf club holders 103 may be provided at the left side and the right side of the cleaning apparatus. The top or cover 102 of the cleaner 100 may include an opening 104 for receiving the golf clubs to be cleaned, which will be discussed further when referring to FIG. 2. The enclosure 101 may also be provided with legs 115 to rest on, which may be adjustable in height. The enclosure 101 may be provided in a hue that helps the golf club cleaner to blend in with the nature of the golf course, or may be decorative in appearance. The enclosure 101 and cover 102 of the golf club cleaner 100 may be shaped such that several golf club cleaners may be fitted together to efficiently make use of space (as will be discussed further when referring to FIG. 10).

Each side of the cleaning apparatus may be provided with a ventilation opening 107. The front side of the cleaning apparatus 100 may be provided with a card reader 108, which may be able to accept cards as payment from users for use of the golf club cleaner 100. The cleaning apparatus may also include software, circuitry, or logic for modulating the apparatus. The card reader may accept and process payment. Once a payment is confirmed to be processed, the apparatus may initiate a cleaning procedure. The user may also actuate a button or touch screen or any other suitable means in order to begin the cleaning procedure after the processing of payment. As an example, the logic may restrict initiation of the cleaning procedure. The card reader may also include a screen, which may display information such as price or service activation status or information. The cleaning apparatus may also be provided with a stop switch 109. An advantage may be that the stop switch 109 may function as a safety device such that a user may quickly shut off the device if needed for safety or any other reasons.

The enclosure 101 of the golf club cleaner 100 may be a body, housing, or frame constructed to house the components that perform washing functions, and the frame may be sectional steel. As an example, each section may be 20×20 millimeters (mm). Some pieces may be welded together. The enclosure may be constructed from, for example, high-quality 1.5 mm thick sheet metal, which may be protected by a primer, a heat-processed final layer of varnish or finish resistant to UV radiation and other weather conditions.

Figure 2:
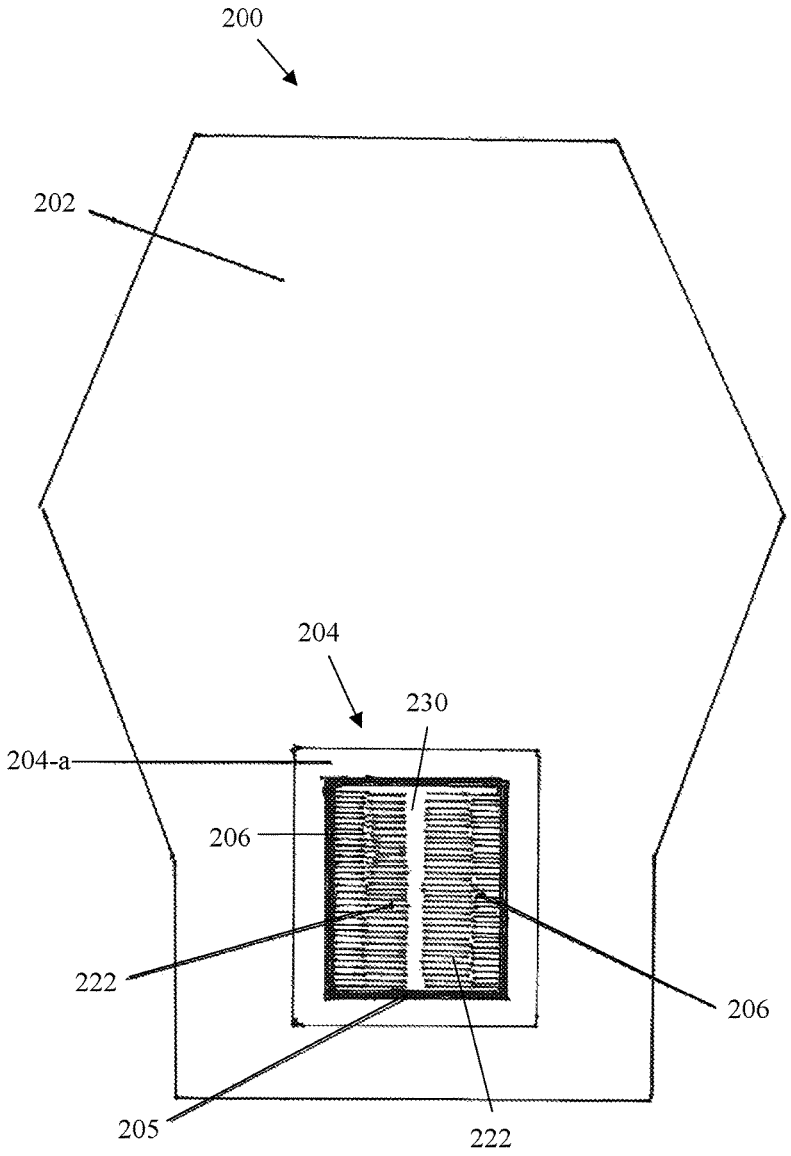
FIG. 2 illustrates the top view of the golf club cleaner, according to an aspect.

FIG. 2 illustrates the top view of the golf club cleaner 200, according to an aspect. The shape of the golf club cleaner 200, which is also shown in FIG. 1B, may be such that several golf club cleaners may be arranged together to make efficient use of space, as will be discussed further when referring to FIG. 10. The cover 202 may include an opening 204 for receiving golf clubs to be cleaned. The head of the golf club may be cleaned by placing it into the opening, or the handle may be placed into the opening for cleaning. The opening 204 may have a reinforced edge 204-*a*, which may, for example, be inox steel. The inner edge 205 may be lined with rubber, for example, such that the softer surface may protect the inserted golf clubs being cleaned, and may help to prevent them from becoming damaged during the cleaning process. The opening 204 may also include an upper water trap 231, onto which brushes for washing the golf clubs may be secured. Small, thin-bristled brooms 206 secured to the inside of the cover may also be provided. In additional to helping to clean the golf clubs, the brooms 206 may also help to prevent water from spraying out of the cleaner 200. The flat, top portion of the cover 202 may also provide a space for advertisements or other material, for example.

Figure 3:
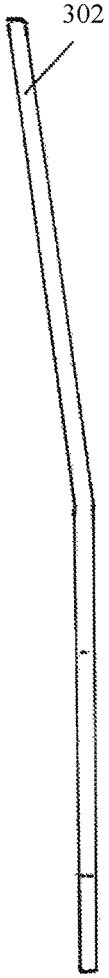
FIG. 3 illustrates the left side view of the cover of the golf club cleaner, the right side being similar, according to an aspect.

FIG. 3 illustrates the left side view of the cover 302 of the golf club cleaner, the right side being similar, according to an aspect. As shown, the cover 302 may be constructed such that a portion slopes downward, which may allow for the flow and discharge of water, such as, for example, precipitation water if the cleaner is used or stored outdoors or on a golf course, for example. An advantage of the sloped cover 302 may be that the accumulation of water inside of the cleaner is prevented.

Figure 4:
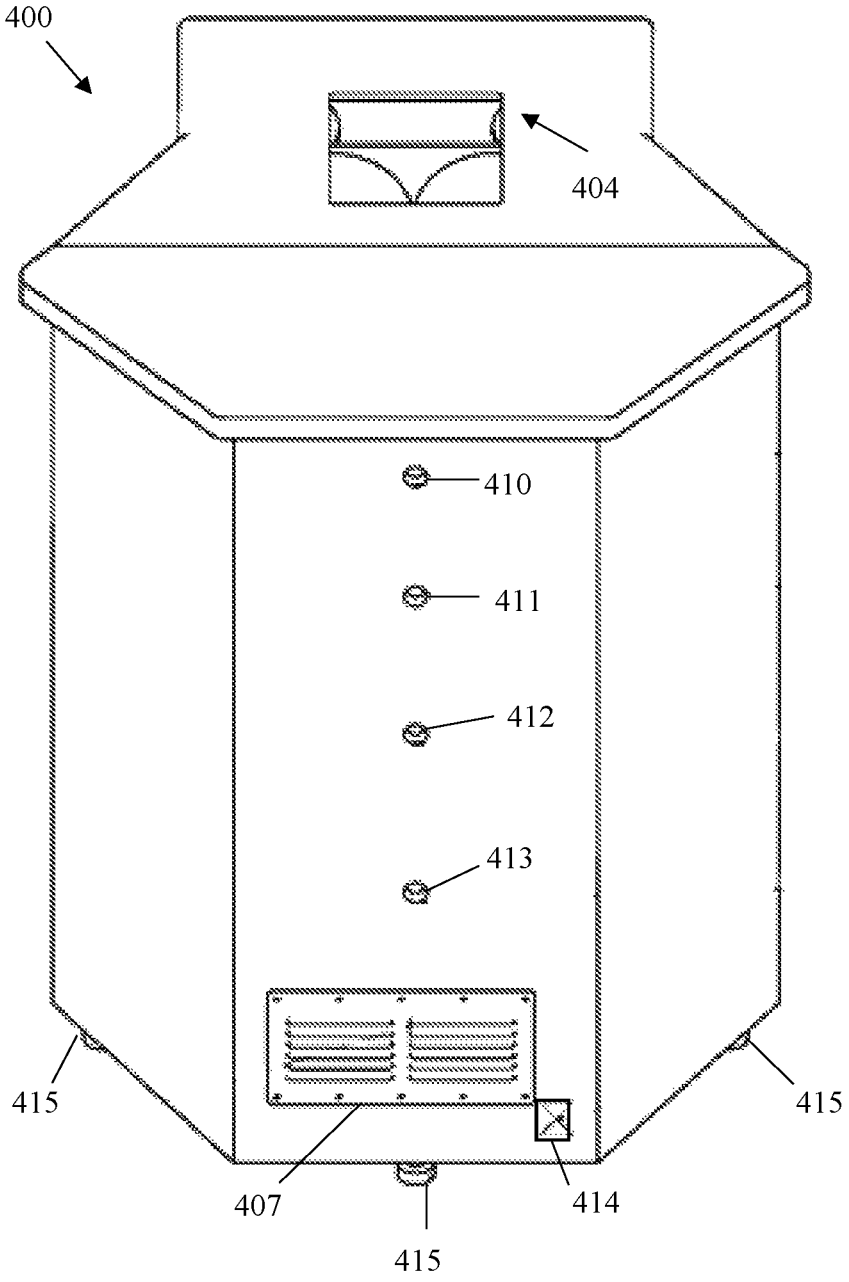
FIG. 4 illustrates the top, rear perspective view of the golf club cleaner, according to an aspect.
Figure 6:
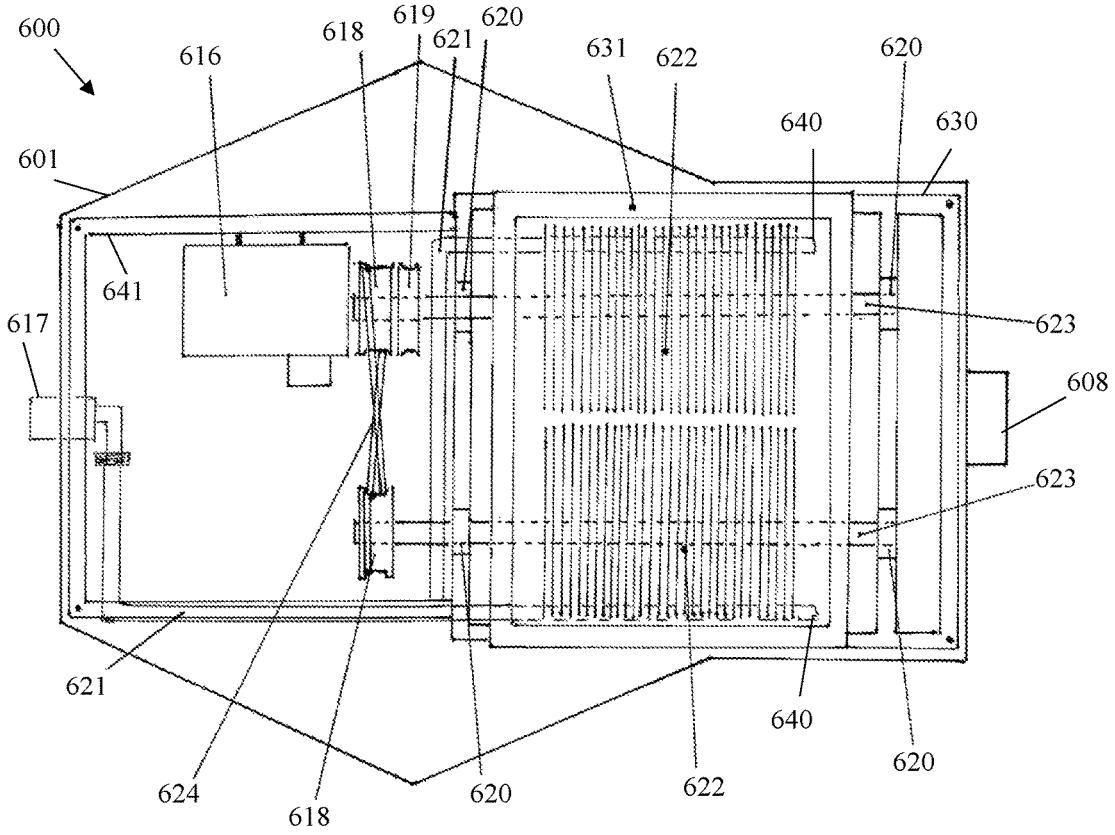
FIG. 6 illustrates the top sectional view of the golf club cleaner, according to an aspect.

FIG. 4 illustrates the top, rear perspective view of the golf club cleaner 400, according to an aspect. The rear of the golf club cleaner 400 may include several openings or ports, such as an opening for the manual water supply regulation valve 410, an opening for a power cable 411, an opening for the electromagnetic water supply valve 412, which may be an electromagnetic valve as known in the art and may be used for the opening and closing when signaled by the engine or motor (as shown in FIG. 6), and an opening for a pipe for waste water discharge 413. The rear of the golf club cleaner 400 may also include a grounding screw 414. Again, the adjustable legs 415 that the cleaner 400 may rest on may be visible from the rear view.

Figure 5:
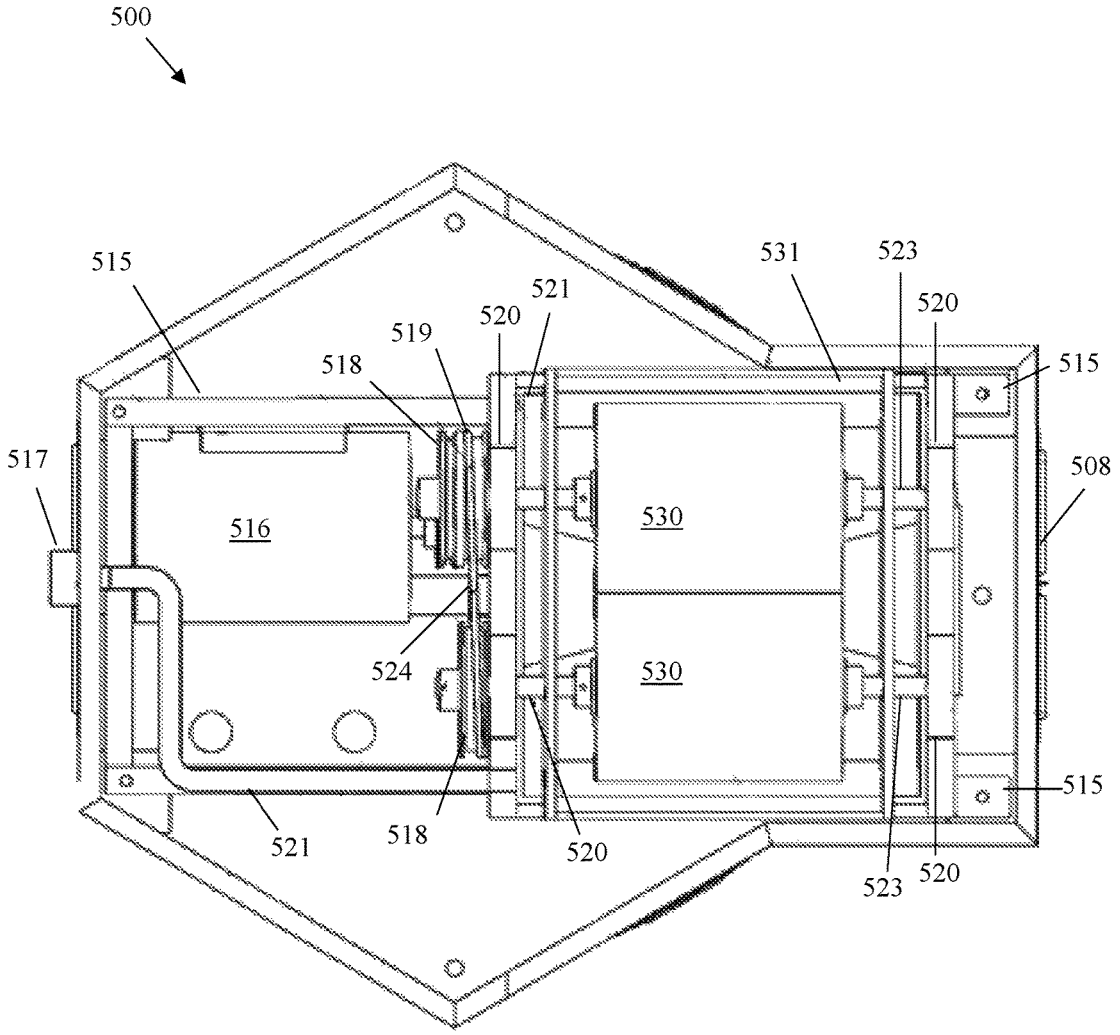
FIG. 5 illustrates the bottom sectional view of golf club cleaner, according to an aspect.

FIG. 5 illustrates the bottom sectional view of golf club cleaner 500, according to an aspect. The cleaner 500 may include adjustable legs 515, an electrical engine or motor 516, an angle valve 517 which may be used for the manual regulation of water flow to the brushes, pulleys system 518 and a drive belt 524, self-adjusting bearings 520, axles 523 on which rotating brushes (as shown by 622 in FIG. 6) may be mounted, a water trap 530 or plurality of water traps 530, and a pipe 521 which may be secured to the valve 517 for the flow of water. The pipe 521 may be constructed from copper, and may, for example, be a single line or may include branches (such as the example shown in FIG. 7A). The water traps may be a single layer or there may be a lower water trap 530 and an upper water trap 531.

The card reader for accepting payment 508 is also shown in this view. Some components for the golf club cleaner may be constructed from inox steel, or any other suitable material. As an example, the axles 523 may be inox steel. The pipe 521 may be constructed from copper.

FIG. 6 illustrates the top sectional view of the golf club cleaner 600, according to an aspect. The golf club cleaner 600 may include rotating brushes 622, which may be obscured from view in the bottom view of FIG. 5 by the water traps) 530 and 531 in FIG. 5). Each water trap may be constructed from an upper portion 630, and a lower portion 631. The brushes 622 may be secured to axles 623, which may be constructed from inox steel. Again, the cleaner 600 may include an electric engine 616. The electrical engine may be screwed onto a support 641 in the interior of the housing. The support 641 may provide a support for attachment of components such as the electrical engine, which may then be welded to the housing 601. The cleaner 600 may also include pulleys 618 having a drive belt 624 and another pulley 619. The drive belt 624 may be associated with the electric engine 616, and may be a round endless belt connecting the two pulleys 618, with a diameter of 5 mm and in the shape of an 8, and may facilitate the rotating movements of the brushes such that the brushes 622 rotate inwards towards each other. Under too heavy a load, the rotation of brushes may stop, which may add to user safety; for example, there may be tension on the belt such that, if there is too large of a load on the brushes, the belt would slip and lose its grip on the pulley, thus, stopping the movement of the brushes. Sprinklers 640 may provide a water spray to the brushes 622 for the cleaning process. An advantage of using two cleaning brushes 622 is that the user may not need to turn or move their golf club manually while it is being cleaned by the machine. The two brushes 622 supported by the axles 623 and self-adjusting bearings 620 which may be biased towards each other, such that a force may be applied to the golf club being cleaned. The self-adjusting bearings 620 may allow for the brushes to be separated to accommodate various sizes of golf clubs to be cleaned while still exerting a pressure on the golf club during the cleaning due to the biasing of the brushes towards each other. As an example, any suitable compressible element or other similar means may be used in place of the self-adjusting bearings 620.

The electrical engine 616 may be a 180 W, 400 V electrical engine, and may also be provided with the cleaner 100 for providing power. The brushes 622 for cleaning a golf club may be constructed from plastic, and may be mounted onto stainless steel axles. The axles may be fastened to the bearings 620, which may be housed in bearing enclosures and screwed onto the support frame 641. The axles may be constructed from cast aluminum or aluminum alloy, and the pulleys may also be constructed from cast aluminum or aluminum alloy, and the pulleys which may include specialized slots for belts or other moving parts. As an example, one slot on the first pulley may be made for a standard drive v-belt.

Figure 7A:
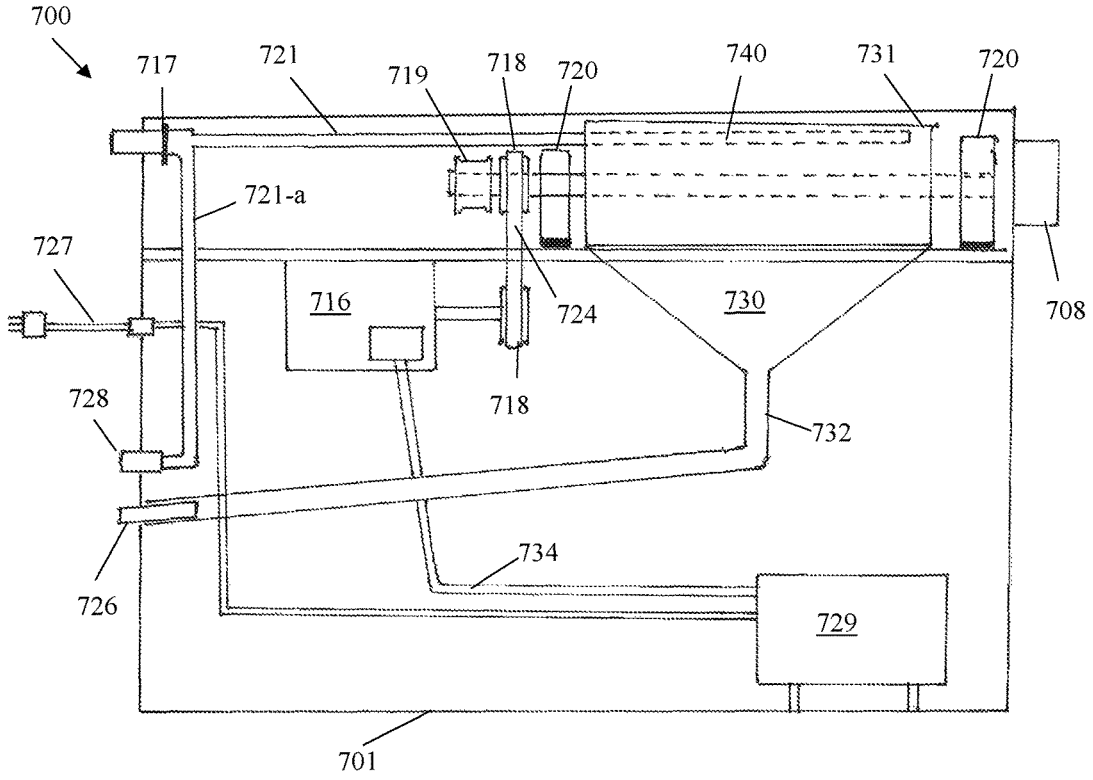
FIGS. 7A-7B illustrate the left side sectional view of the golf club cleaner, and another example of the left side sectional view, respectively, according to an aspect.
Figure 7B:
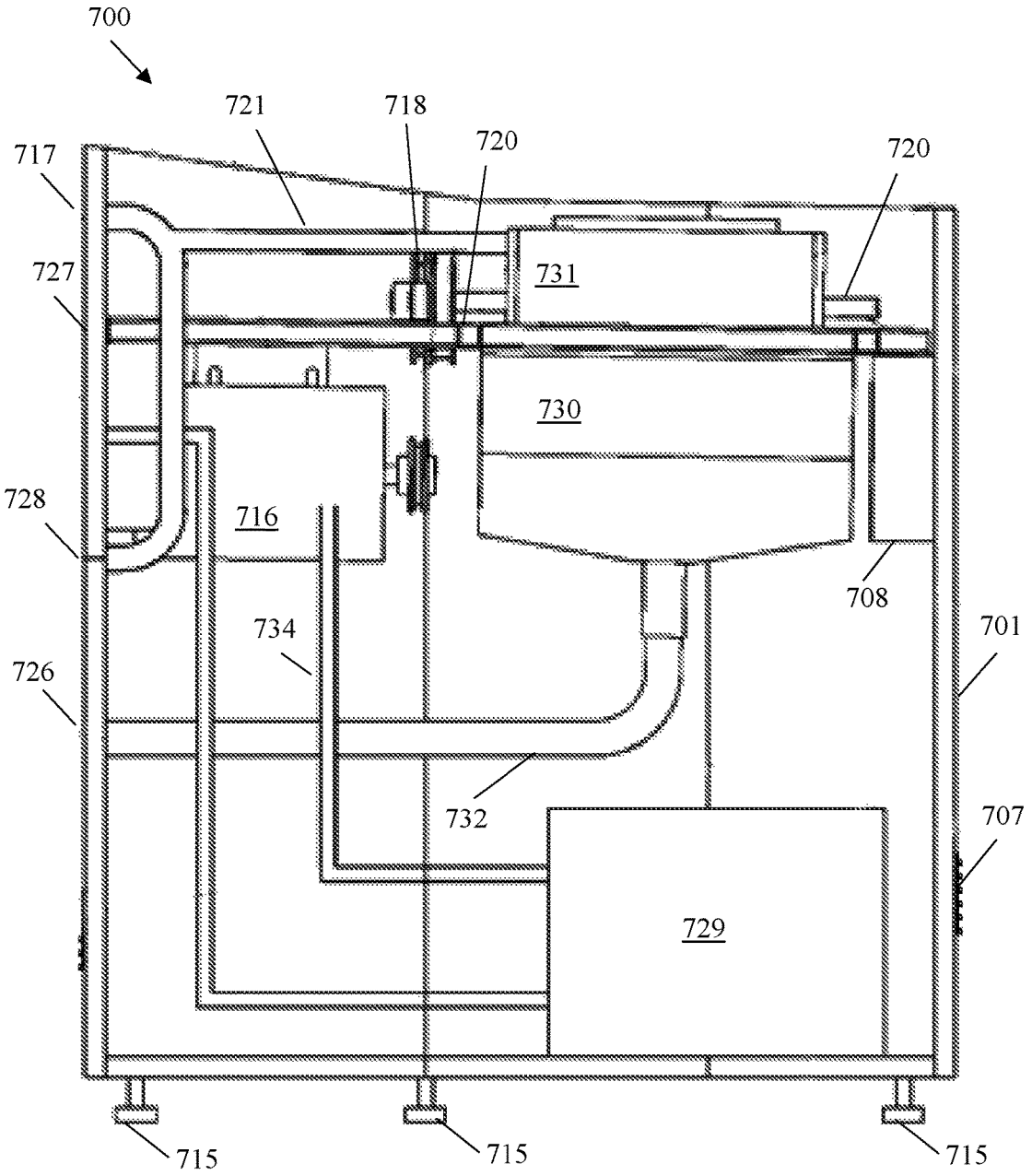

FIGS. 7A-7B illustrate the left side sectional view of the golf club cleaner 700, and another example of the left side sectional view, respectively, according to an aspect. The cleaner 700 may include water traps, which may be a lower water trap 730 and an upper water trap 731. The lower water trap 730 may be a drain funnel, and the upper water trap 731 may house the brushes, axles, water spraying pipe (as shown in FIG. 6), and seals or brooms (as shown by 206 in FIG. 2) for preventing the spraying of water out of the machine. The water traps 730 and 731 may be, for example, constructed from inox steel, and the brushes 722 used for cleaning the golf clubs may be secured to the upper water trap 731 (again, as shown in FIG. 6).

The electric engine 716 may, for example, be secured to the interior of the enclosure 701 by, for example, screws (not shown). A valve 717 for the regulation of the flow of water may direct water flow into, for example, two branches such as the pipe 721 and the pipe branch 721-*a*, and the valve may be associated with the opening for the manual water supply regulation valve 410 of FIG. 4. The cleaner may also include a power supply cable 727 (which may go through the opening for the power cable 411 of FIG. 4). An electromagnetic valve 728 (which may go through the opening for the electromagnetic water supply valve 412 of FIG. 4) may be associated with the end of the pipe branch 721-*a* The electromagnetic valve 728 may be connected with an angle valve 717, which, again, may be used to regulate the flow of water, and may be adjustable. This valve 717 may be connected to a water delivery pipe, which may be a copper pipe 721. The water delivery pipe 731 may be configured to deliver water to the brushes for the cleaning procedure, and the delivery pipe may lead to the upper water trap 731 where the cleaning procedure may take place. When the cleaner 700 is turned on, the electromagnetic valve 728 may open the flow of water, which may then be regulated by the angle valve 717. Water may then continue through the copper pipe, which may include sprinklers 740 to supply water to the brushes.

A discharge pipe or waste water pipe 732 may be associated with a GK coupler 726 for the discharge of waste water produced after the cleaning of the golf clubs (which may go through the opening for the waste water discharge pipe 413 of FIG. 4). Again, the cleaner 700 may also include self-adjusting bearings 720, which may be secured to the axles by screws. The cleaner may rest on adjustable legs 715. The front of the cleaner 700 may include a ventilation duct 707, and a card reader 708 (shown partially). The pulleys 718 may be associated with a drive belt 724, and also associated with a pulley 719. The drive belt 724 may be associated with the electrical engine 716. Pulleys 718 may be connecting pulleys that provide the counter rotation of the pair of brushes, and be connected by a round belt of 5 mm diameter and length of 630 mm. The main pulley 719 may be driven by the electric motor.

As an example of an exemplary method, a user may first insert a payment into the card reader to access the cleaner. Next, a price and service or status information may be displayed on the screen of the card reader. Next, the frequency inverter 729, which may be connected to the engine via a line 734, may engage the following functions: A soft starter as known in the art may be used to start the rotation of the brushes, and the rotation may occur with the two brushes turning inwardly towards each other. The electromagnetic water supply valve at the rear of the device may switch on, which may allow water to run via a brinox pipe towards a ½ inch valve 728 to copper pipe 721, which may be associated with sprinklers 740 that are installed next to each of the brushes. The sprinklers 740 may be holes provided in the copper pipe 721, or may be drilled into the pipe, and the holes may be drilled at a 125-degree angle. An advantage may be that the spray of water provided by the sprinklers may cover the entire width of the brushes. Again, to prevent water from spraying to the outside, a blocking device made of thin plastic bristles with an aluminum section may be provided on the opening of the cleaner. The regulation valve may be used to control the supply of water manually. As an example, various weather conditions may require different levels of water flow. During operation of the cleaner, waste water may be released through a funnel into a discharge pipe, and the waste water may be released onto the golf course, for example, or any suitable drainage system.

Figure 8A:
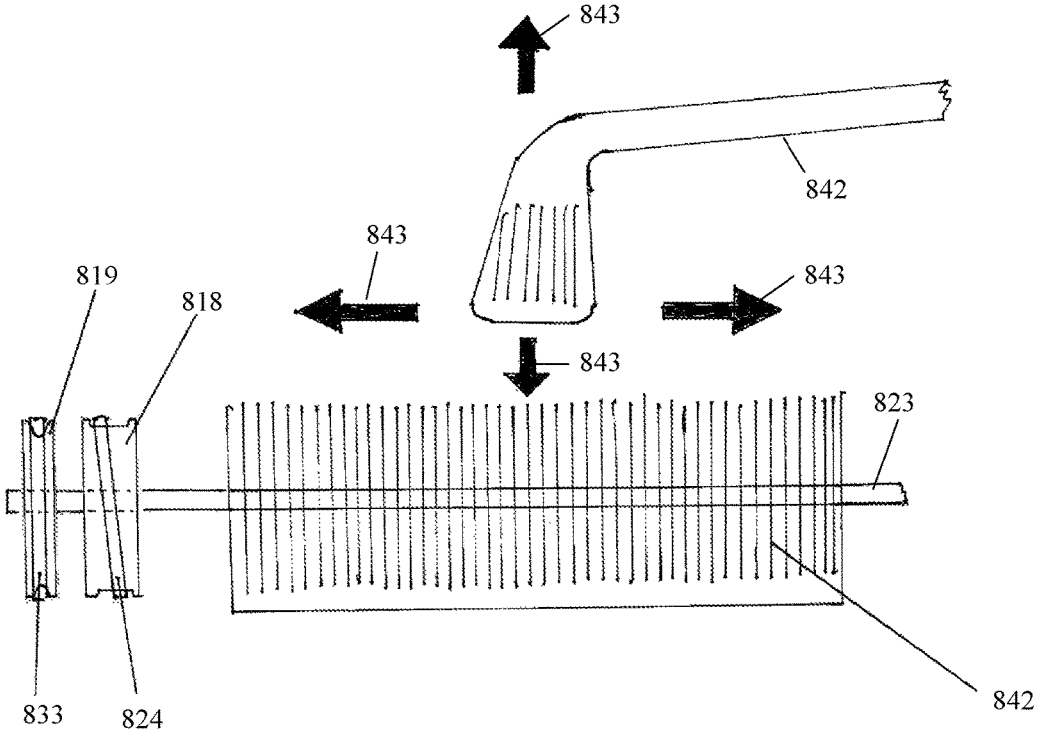
FIGS. 8A-8B illustrate the sectional side view of the cleaning portion of the golf cleaner with a partial side view of a golf club, and another example of the side view, according to an aspect.
Figure 8B:
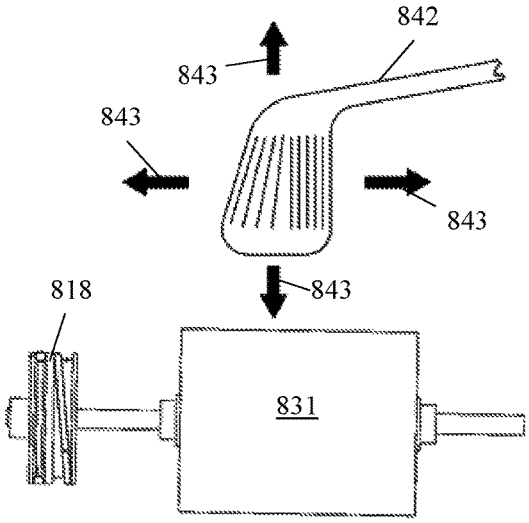

FIGS. 8A-8B illustrate the sectional side view of the cleaning portion of the golf cleaner with a partial side view of a golf club 842, and another example of the side view, according to an aspect. A golf club 842 may be inserted into the cleaner between the two brushes 822 (a single brush 822 is visible in the sectional side view of FIG. 8A). The brushes may be housed within the upper water trap 831. Once the golf club head or handle is inserted between the brushes within the upper water trap 831, the brushes may clean the golf club 842 by rotating. The movement of the brushes may be provided by the pulleys 818 and 819 driven by the electrical engine via drive belts 824 and 833. The brushes 822 being present on either side of the golf club 842 may provide a more efficient way for the user to clean their golf club by eliminating the need for the user to manually turn or move the golf club; however, if needed to achieve a more thorough clean, the user may also move or turn the golf club 842 in the directions indicated by arrows 843.

Figure 9A:
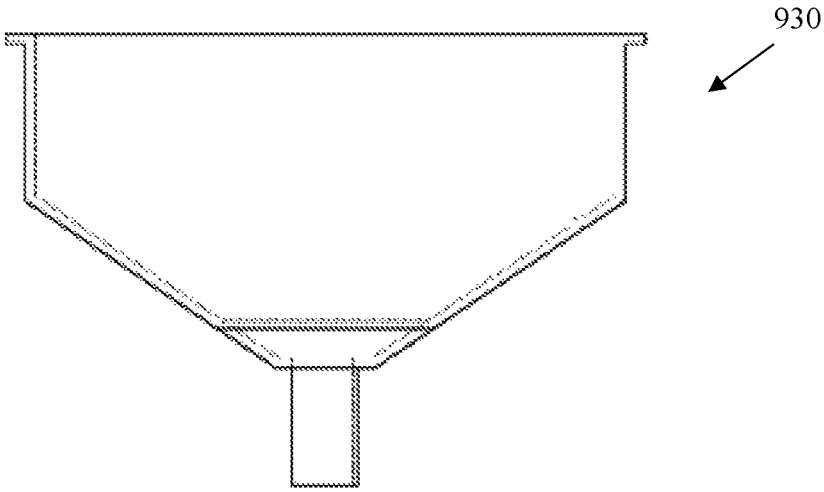
FIGS. 9A-9B illustrate the side elevation view and the top plan view, respectively, of the lower water trap, according to an aspect.
Figure 9B:
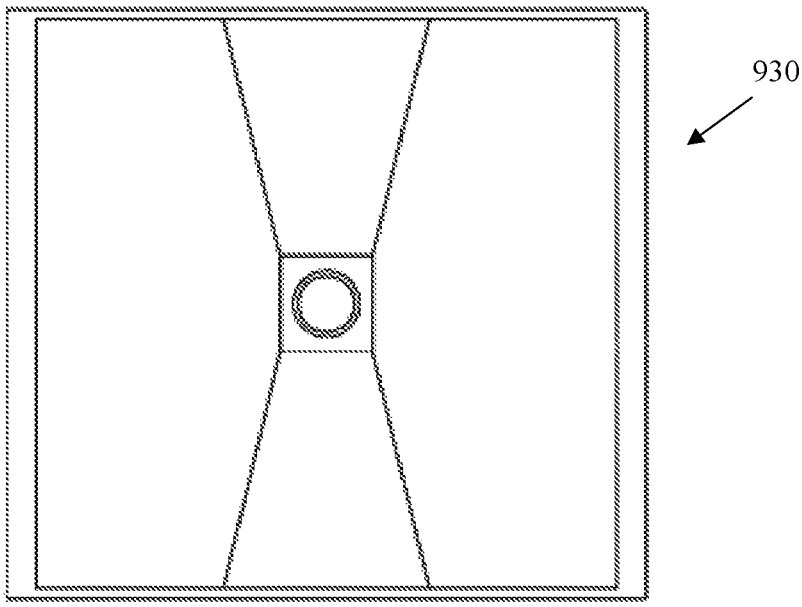

FIGS. 9A-9B illustrate the side elevation view and the top plan view, respectively, of the lower water trap 930, according to an aspect. Again, the lower water trap 930 may be funnel-shaped in order to drain the waste water used during the cleaning process.

Figure 10A:
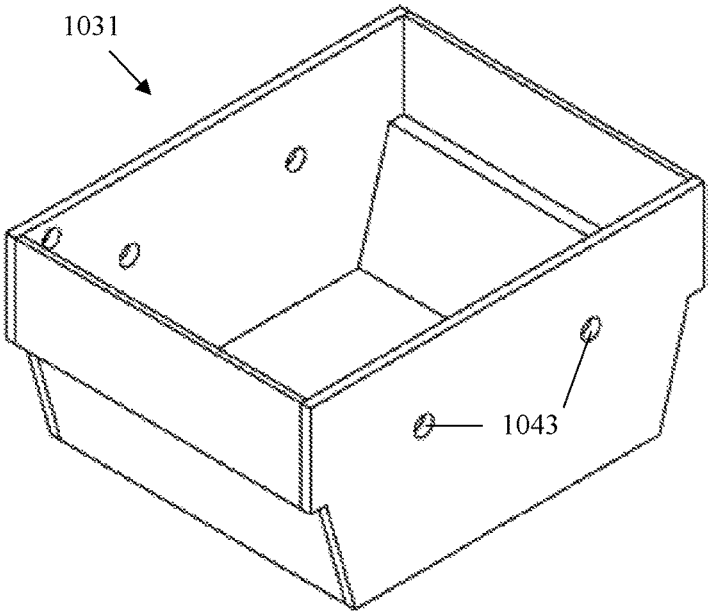
FIGS. 10A-10B illustrate the top perspective views of the upper water trap, and another example of the upper water trap, respectively, according to an aspect.
Figure 10B:
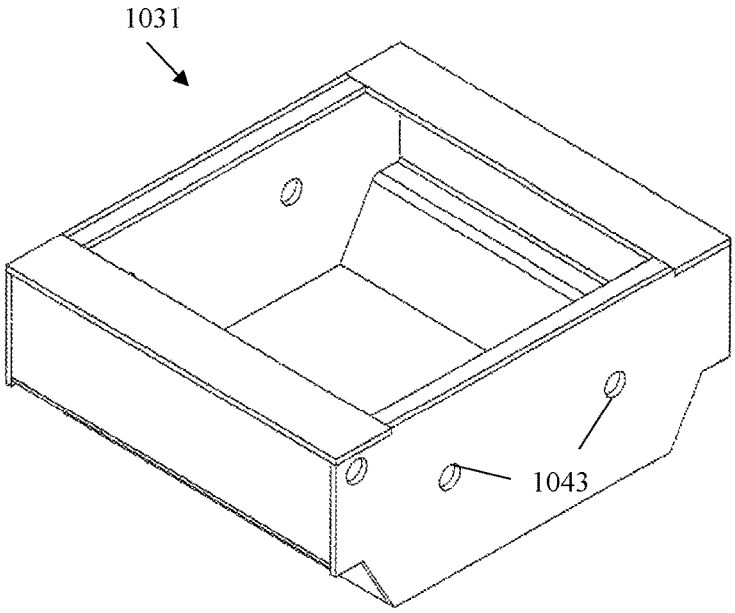

FIGS. 10A-10B illustrate the top perspective views of the upper water trap 1031, and another example of the upper water trap 1031, respectively, according to an aspect. The upper water trap 1031 may include holes 1043 to receive the axles (as shown by 823 in FIG. 8A) which hold the brushes. The brushes may thus be contained within the upper water trap 1031. Overflow of waste water from the upper water trap 1031 may then fall into the lower water trap (as shown by 930 in FIGS. 9A-9B) and be drained out of the golf club cleaning apparatus.

Figure 11:
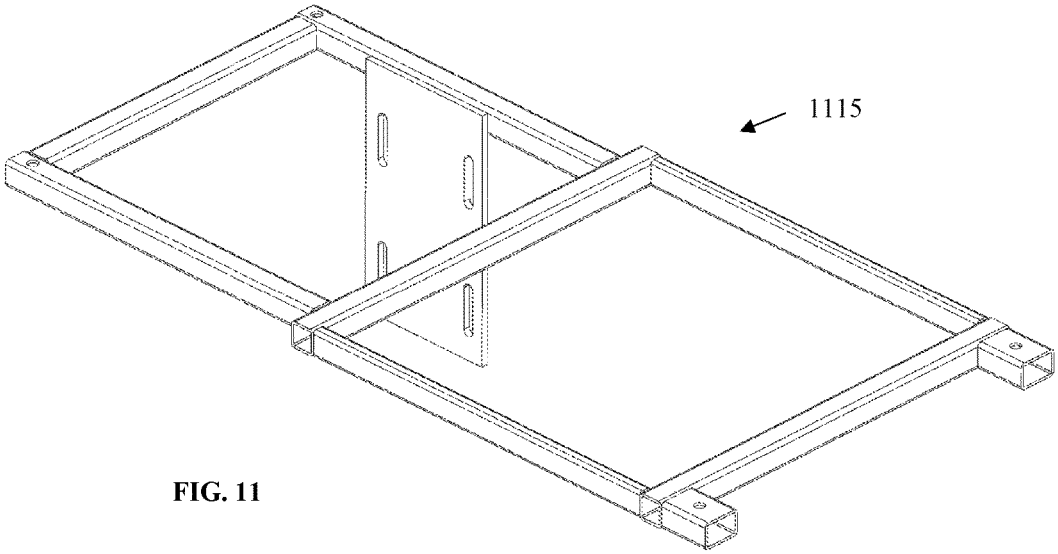
FIG. 11 illustrates the side perspective view of an adjustable leg for the golf club cleaner, according to an aspect.

FIG. 11 illustrates the side perspective view of an adjustable leg 1115 for the golf club cleaner, according to an aspect. As an example, an adjustable leg as shown may be used such that two pieces are affixed to the cleaner, each of the two pieces having two feet. As another example, each adjustable leg piece having a foot may be separate pieces. The legs may be telescopic or may be adjustable in height by any suitable means.

Figure 12A:
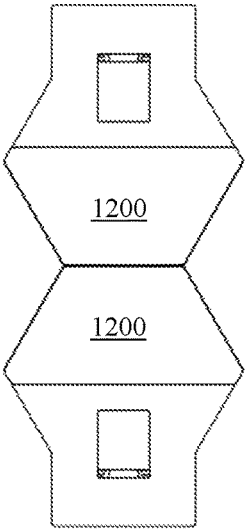
FIGS. 12A-12E illustrate the top plan views of various examples of spatial arrangements using a plurality of golf club cleaners, according to an aspect.
Figure 12B:
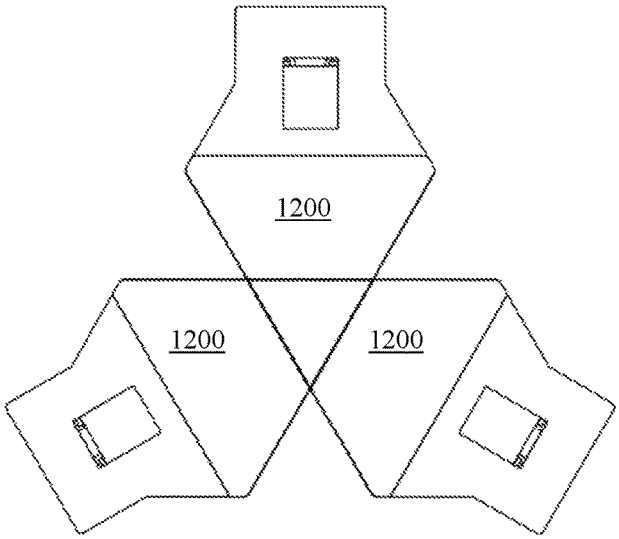
Figure 12C:
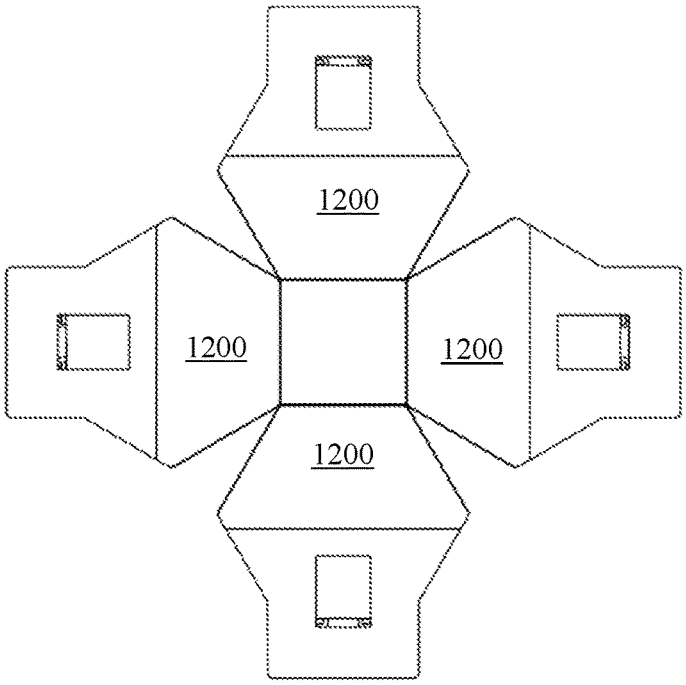
Figure 12D:
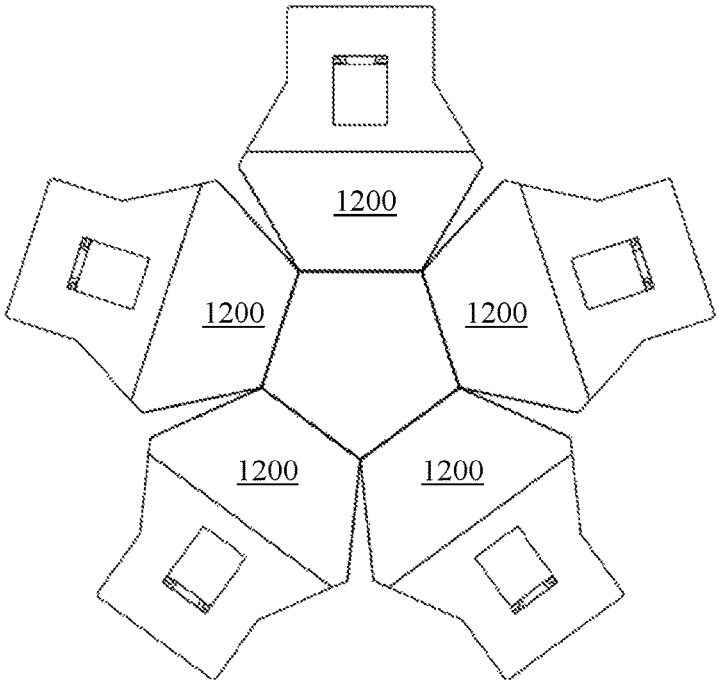
Figure 12E:
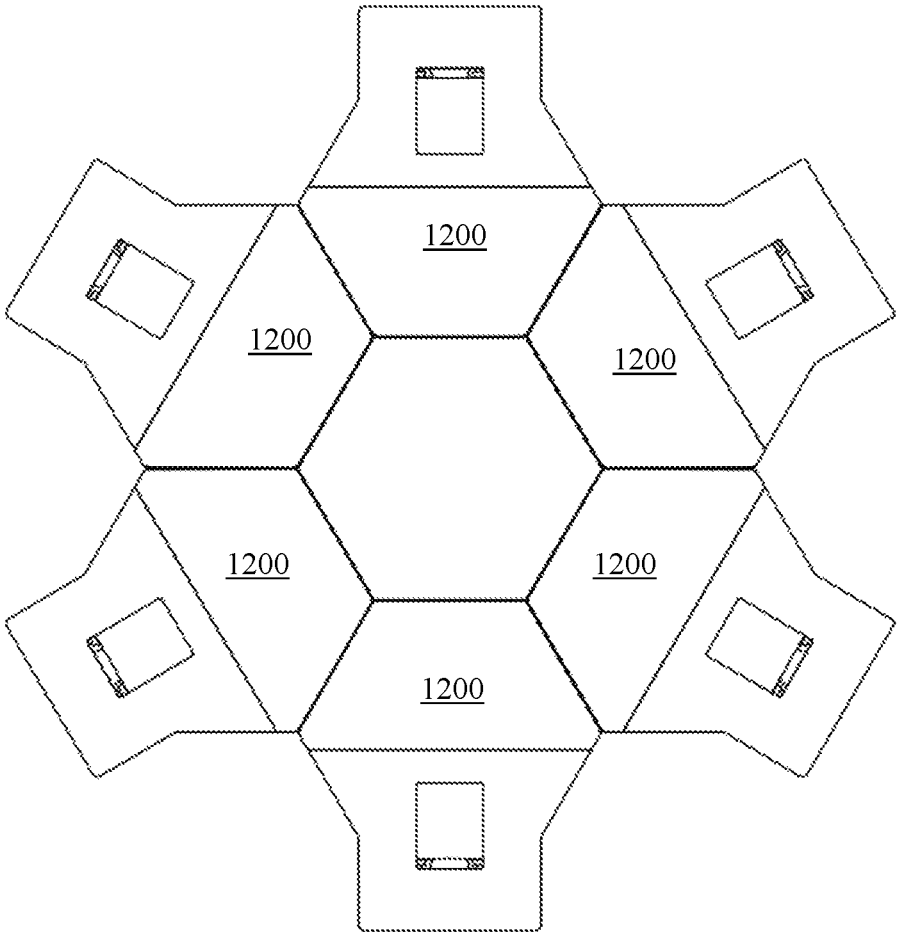

FIGS. 12A-12E illustrate the top plan views of various examples of spatial arrangements using a plurality of golf club cleaners 1200, according to an aspect. As an example, a plurality of golf club cleaners 1200 can be shaped such that they may be arranged with an efficient use of space. FIG. 12A shows two cleaners 1200, FIG. 12B shows three cleaners 1200, FIG. 12C shows four cleaners 1200, FIG. 12D shows five cleaners 1200, and FIG. 12E shows six cleaners 1200. As an example, each golf club cleaning apparatus 1200 may have eight sides, which may thus assist or guide the user in the arrangement of a plurality of cleaners.

It may be advantageous to set forth definitions of certain words and phrases used in this patent document. The term "couple" and its derivatives refer to any direct or indirect communication between two or more elements, whether or not those elements are in physical contact with one another. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Further, as used in this application, "plurality" means two or more. A "set" of items may include one or more of such items. Whether in the written description or the claims, the terms "comprising," "including," "carrying," "having," "containing," "involving," and the like are to be understood to be open-ended, i.e., to mean including but not limited to. Only the transitional phrases "consisting of" and "consisting essentially of," respectively, are closed or semi-closed transitional phrases with respect to claims.

If present, use of ordinal terms such as "first," "second," "third," etc., in the claims to modify a claim element does not by itself connote any priority, precedence or order of one claim element over another or the temporal order in which acts of a method are performed. These terms are used merely as labels to distinguish one claim element having a certain name from another element having a same name (but for use of the ordinal term) to distinguish the claim elements. As used in this application, "and/or" means that the listed items are alternatives, but the alternatives also include any combination of the listed items.

Throughout this description, the aspects, embodiments or examples shown should be considered as exemplars, rather than limitations on the apparatus or procedures disclosed or claimed. Although some of the examples may involve specific combinations of method acts or system elements, it should be understood that those acts and those elements may be combined in other ways to accomplish the same objectives.

Acts, elements and features discussed only in connection with one aspect, embodiment or example are not intended to be excluded from a similar role(s) in other aspects, embodiments or examples.

Aspects, embodiments or examples of the invention may be described as processes, which are usually depicted using a flowchart, a flow diagram, a structure diagram, or a block diagram. Although a flowchart may depict the operations as a sequential process, many of the operations can be performed in parallel or concurrently. In addition, the order of the operations may be re-arranged. With regard to flowcharts, it should be understood that additional and fewer steps may be taken, and the steps as shown may be combined or further refined to achieve the described methods.

If means-plus-function limitations are recited in the claims, the means are not intended to be limited to the means disclosed in this application for performing the recited function, but are intended to cover in scope any equivalent means, known now or later developed, for performing the recited function.

If any presented, the claims directed to a method and/or process should not be limited to the performance of their steps in the order written, and one skilled in the art can readily appreciate that the sequences may be varied and still remain within the spirit and scope of the present invention.

Although aspects, embodiments and/or examples have been illustrated and described herein, someone of ordinary skills in the art will easily detect alternate of the same and/or equivalent variations, which may be capable of achieving the same results, and which may be substituted for the aspects, embodiments and/or examples illustrated and described herein, without departing from the scope of the invention. Therefore, the scope of this application is intended to cover such alternate aspects, embodiments and/or examples. Hence, the scope of the invention is defined by the accompanying claims and their equivalents. Further, each and every claim is incorporated as further disclosure into the specification.

What is claimed is:

1. A golf club cleaning apparatus for performing a cleaning procedure on a golf club, the apparatus comprising:

a housing having eight side walls, a top side, a bottom side, an exterior surface and a hollow interior;

a plurality of ventilation openings on the housing;

a plurality of golf club holders on the exterior surface of the housing;

a support frame within the housing and secured to the hollow interior;

wherein one of the eight side walls is a rear side wall, the rear side wall having:

an electromagnetic water supply valve opening providing access for a water supply pipe into the apparatus, wherein the water supply pipe has an electromagnetic water supply valve configured to open or close the water supply pipe, such that water enters the water supply pipe when the electromagnetic water supply valve is opened and flows towards a regulation valve;

a regulation valve opening providing a user access to the regulation valve, the regulation valve being configured to control a flow of the water from the water supply pipe and direct the water into a water delivery pipe having a first pipe branch and a second pipe branch;

a power cable opening permitting passage of a power cable connected to a frequency inverter to provide a power supply to the apparatus;

a waste water pipe opening permitting passage of a waste water pipe out of the apparatus;

a cover on the top side of the housing, the cover having a downward slope and a top opening having a rubber edging and broom bristles configured to reduce a spray of water out of the apparatus, the top opening permitting access to an upper water trap and components housed by the upper water trap; the components housed by the upper water trap comprising:

a first axle and a second axle, the first and second axles being received into the upper water trap through a first set of holes on a first upper water trap side wall, and the first axle and the second axle passing out of the upper water trap through a second set of holes on an opposite second side wall;

the first axle being associated with a first brush, and the second axle being associated with a second brush, the first brush and the second brush being accessible through the top opening;

the first axle and the second axle being associated with the support frame via a set of compressible elements biasing the first axle and the second axle towards each other and thus biasing the first brush and the second brush towards each other, and permitting a separation of the brushes when a force of is applied between the first brush and the second brush;

the first brush and the second brush being configured to engage in a rotational movement towards each other via the drive belt driven by the electric motor; and the first pipe branch having a first set of sprinklers to discharge the water to the first brush, and the second pipe branch having a second set of sprinklers to discharge water to the second brush;

a lower water trap underneath the upper water trap configured to catch waste water generated by the cleaning procedure, the lower water trap having a funnel shape and connected to the waste water pipe such that the waste water is drained out of the apparatus;

an electrical motor associated with the frequency inverter, the electric motor configured to drive the rotational movement of the axles via a drive belt;

a pulley pair and a main pulley associated with the drive belt configured to drive the rotational movement of the axles and thus a rotational movement of the brushes;

and wherein one of the eight side walls is a front side wall having:

an emergency shut-off switch configured to turn off the electric motor when actuated by the user; and a card reader configured to accept and process a payment, and associated with a logic configured to restrict an initiation of the cleaning procedure until the payment is processed;

such that the user is permitted use of the cleaning procedure for the golf club after providing the payment.

2. The golf club cleaning apparatus of claim 1, further comprising adjustable legs associated with the bottom side of the housing, the adjustable legs being configured to change a height of the apparatus.

3. The golf club cleaning apparatus of claim 1, wherein the housing is constructed from inox steel.

4. The golf club cleaning apparatus of claim 1, wherein the water supply pipe and the water delivery pipe are constructed from copper.

5. The golf club cleaning apparatus of claim 1, wherein the set of compressible elements is a set of self-adjusting bearings.

6. The golf club cleaning apparatus of claim 1, wherein the plurality of ventilation openings comprises one ventilation on each one of the eight side walls.

7. The golf club cleaning apparatus of claim 1, further comprising a screen associated with the card reader.

8. A golf club cleaning apparatus for performing a cleaning procedure on a golf club, the apparatus comprising:

a housing having eight side walls, a top side, a bottom side, an exterior surface and a hollow interior;

an electromagnetic water supply valve opening providing access for a water supply pipe into the apparatus, wherein the water supply pipe has an electromagnetic water supply valve configured to open or close the water supply pipe, such that water enters the water supply pipe when the electromagnetic water supply valve is opened and flows towards a water delivery pipe having a first pipe branch and a second pipe branch;

a power cable opening permitting passage of a power cable connected to a frequency inverter to provide a power supply to the apparatus;

a waste water pipe opening permitting passage of a waste water pipe out of the apparatus;

a cover on the top side of the housing, the cover having a top opening permitting access to an upper water trap and components housed by the upper water trap; the components housed by the upper water trap comprising:

a first axle and a second axle, the first and second axles being received into the upper water trap through a first set of holes on a first upper water trap side wall, and the first axle and the second axle passing out of the upper water trap through a second set of holes on an opposite second side wall;

the first axle being associated with a first brush, and the second axle being associated with a second brush, the first brush and the second brush being accessible through the top opening;

the first axle and the second axle being associated with an interior surface of the housing via a set of compressible elements biasing the first axle and the second axle towards each other and thus biasing the first brush and the second brush towards each other, and permitting a separation of the brushes when a force of is applied between the first brush and the second brush;

the first brush and the second brush being configured to engage in a rotational movement towards each other via the drive belt driven by the electric motor; and the first pipe branch having a first set of sprinklers to discharge the water to the first brush, and the second pipe branch having a second set of sprinklers to discharge water to the second brush;

a lower water trap underneath the upper water trap configured to catch waste water generated by the cleaning procedure, the lower water trap being connected to the waste water pipe such that the waste water is drained out of the apparatus;

means for driving the rotational movement of the axles and thus a rotational movement of the brushes, the means for driving the rotational movement being powered by an electrical motor associated with the frequency inverter; and a card reader configured to accept and process a payment, and associated with a logic configured to restrict an initiation of the cleaning procedure until the payment is processed;

such that a user is permitted use of the cleaning procedure for the golf club after providing the payment.

9. The golf club cleaning apparatus of claim 8, further comprising:

a regulation valve positioned between the water supply pipe and the water delivery pipe; and a regulation valve opening providing the user access to the regulation valve, the regulation valve being configured to control a flow of the water from the water supply pipe and direct the water into the water delivery pipe.

10. The golf club cleaning apparatus of claim 9, wherein the water supply pipe and the water delivery pipe are constructed from copper.

11. The golf club cleaning apparatus of claim 8, further comprising adjustable legs associated with the bottom side of the housing, the adjustable legs being configured to change a height of the apparatus.

12. The golf club cleaning apparatus of claim 8, wherein the housing is constructed from inox steel.

13. The golf club cleaning apparatus of claim 8, wherein the set of compressible elements is a set of self-adjusting bearings.

14. A golf club cleaning apparatus for performing a cleaning procedure on a golf club, the apparatus comprising:

a housing having eight side walls, a top side, a bottom side, an exterior surface and a hollow interior;

a water supply pipe and means for opening and closing the water supply pipe, the water supply pipe being connected to a water delivery pipe;

a power cable connected to a frequency inverter to provide a power supply to the apparatus;

a waste water pipe;

a cover on the top side of the housing, the cover having a top opening permitting access to an upper water trap and components housed by the upper water trap; the components housed by the upper water trap comprising:

a first axle associated with a first brush, and a second axle associated with a second brush, the first brush and the second brush being accessible through the top opening;

the first axle and the second axle being associated with an interior surface of the housing via a set of compressible elements biasing the first axle and the second axle towards each other and thus biasing the first brush and the second brush towards each other, and permitting a separation of the brushes when a force of is applied between the first brush and the second brush;

the first brush and the second brush being configured to engage in a rotational movement towards each other via a drive belt driven by the electric motor; and a plurality of sprinklers associated with the water supply pipe configured to discharge water to the first brush and the second brush;

a lower water trap underneath the upper water trap configured to catch waste water generated by the cleaning procedure, the lower water trap being connected to the waste water pipe such that the waste water is drained out of the apparatus;

means for driving the rotational movement of the axles and thus a rotational movement of the brushes, the means for driving the rotational movement being powered by an electrical motor associated with the frequency inverter; and a card reader configured to accept and process a payment, and associated with a logic configured to restrict an initiation of the cleaning procedure until the payment is processed;

such that the user is permitted use of the cleaning procedure for the golf club after providing the payment.

15. The golf club cleaning apparatus of claim 14, wherein the means for opening and closing the water supply pipe is an electromagnetic valve.

16. The golf club cleaning apparatus of claim 14, further comprising:

a regulation valve positioned between the water supply pipe and the water delivery pipe; and a regulation valve opening providing the user access to the regulation valve, the regulation valve being configured to control a flow of the water from the water supply pipe and direct the water into the water delivery pipe.

17. The golf club cleaning apparatus of claim 16, wherein the water supply pipe and the water delivery pipe are constructed from copper.

18. The golf club cleaning apparatus of claim 14, further comprising adjustable legs associated with the bottom side of the housing, the adjustable legs being configured to change a height of the apparatus.

19. The golf club cleaning apparatus of claim 14, wherein the set of compressible elements is a set of self-adjusting bearings.

20. The golf club cleaning apparatus of claim 14, wherein the top opening further comprises a rubber edging.

* * * * *